US009406438B2

(12) United States Patent
Yokoyama

(10) Patent No.: US 9,406,438 B2
(45) Date of Patent: Aug. 2, 2016

(54) STACK-TYPE INDUCTOR ELEMENT AND METHOD OF MANUFACTURING THE SAME

(71) Applicant: Murata Manufacturing Co., Ltd., Nagaokakyo-shi, Kyoto-fu (JP)

(72) Inventor: Tomoya Yokoyama, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 65 days.

(21) Appl. No.: 14/226,852

(22) Filed: Mar. 27, 2014

(65) Prior Publication Data

US 2014/0266551 A1 Sep. 18, 2014

Related U.S. Application Data

(63) Continuation of application No. PCT/JP2013/079104, filed on Oct. 28, 2013.

(30) Foreign Application Priority Data

Mar. 18, 2013 (JP) ..... 2013-054613

(51) Int. Cl.

| | |
|---|---|
| ***H01F 5/00*** | (2006.01) |
| ***H01F 27/29*** | (2006.01) |
| ***H01F 41/02*** | (2006.01) |
| ***H01F 27/25*** | (2006.01) |

(52) U.S. Cl.

CPC ..... *H01F 41/0213* (2013.01); *H01F 5/00* (2013.01); *H01F 27/25* (2013.01); *H01F 27/29* (2013.01); *Y10T 29/49075* (2015.01)

(58) Field of Classification Search

CPC ..... H01F 5/00; H01F 27/00–27/30

USPC ..... 336/65, 83, 200, 232–234, 192

See application file for complete search history.

(56) References Cited

U.S. PATENT DOCUMENTS

| | | | | |
|---|---|---|---|---|
| 7,446,639 | B2 * | 11/2008 | Yokoyama | H01F 27/2804 257/724 |
| 7,741,943 | B2 * | 6/2010 | Fouquet | H01F 27/2804 336/200 |
| 7,948,346 | B2 * | 5/2011 | Hebert | H01F 17/0033 336/200 |

(Continued)

FOREIGN PATENT DOCUMENTS

| | | | |
|---|---|---|---|
| JP | 2002-175917 | A | 6/2002 |
| JP | 2002-270428 | A | 9/2002 |

(Continued)

OTHER PUBLICATIONS

Official Communication issued in corresponding United Kingdom Patent Application No. 1404392.1, mailed on Jul. 31, 2014.

(Continued)

*Primary Examiner* — Tuyen Nguyen

(74) *Attorney, Agent, or Firm* — Keating & Bennett, LLP

(57) ABSTRACT

A stack-type inductor element includes a stack including a magnetic element layer, a coil-shaped conductor pattern provided in the stack, a plurality of first pad electrodes provided on one main surface of the stack, and a plurality of second pad electrodes provided on the other main surface of the stack and symmetric to the plurality of first pad electrodes. The stack is rectangular or substantially rectangular when viewed in a direction of stack of the stack. A first end and a second end of the coil-shaped conductor pattern are electrically connected to two of the plurality of first pad electrodes, respectively, and the plurality of second pad electrodes are all electrically open.

7 Claims, 21 Drawing Sheets

(56) References Cited

U.S. PATENT DOCUMENTS

| | | | | |
|---|---|---|---|---|
| 8,624,701 | B2 * | 1/2014 | Zeng | H01F 27/29 257/528 |
| 8,824,161 | B2 * | 9/2014 | Askarinya | H01F 27/2804 320/108 |
| 2010/0308949 | A1 | 12/2010 | Lim et al. | |
| 2012/0091210 | A1 | 4/2012 | Koujima et al. | |
| 2013/0062994 | A1 | 3/2013 | Ogawa et al. | |
| 2013/0314194 | A1 * | 11/2013 | Sato | H01F 17/0013 336/200 |
| 2014/0176286 | A1 | 6/2014 | Okada et al. | |

FOREIGN PATENT DOCUMENTS

| | | | |
|---|---|---|---|
| JP | 2003-59722 | A | 2/2003 |
| JP | 2004-063769 | A | 2/2004 |
| JP | 2007-173713 | A | 7/2007 |
| JP | 2009-111197 | A | 5/2009 |
| JP | 2009-231331 | A | 10/2009 |
| JP | 2012-199353 | A | 10/2012 |
| WO | 2010/113751 | A1 | 10/2010 |
| WO | 2013/031842 | A1 | 3/2013 |

OTHER PUBLICATIONS

Official Communication issued in International Patent Application No. PCT/JP2013/079104, mailed on Dec. 3, 2013.

Yokoyama, "Stack-Type Inductor Element and Method of Manufacturing the Same, and Communication Device", U.S. Appl. No. 14/205,406, filed Mar. 12, 2014.

Yokoyama et al.; "Antenna"; U.S. Appl. No. 29/484,789, filed Mar. 13, 2014.

* cited by examiner

STACK-TYPE INDUCTOR ELEMENT AND METHOD OF MANUFACTURING THE SAME

BACKGROUND OF THE INVENTION

1. Field of the Invention

The present invention relates to a stack-type inductor element, and particularly to a stack-type inductor element including a stack obtained by stacking a magnetic element layer and a non-magnetic element layer and a conductor pattern located on opposing surfaces of the magnetic element layer which defines a portion of the inductor.

The present invention also relates to a manufacturing method of manufacturing such a stack-type inductor element.

2. Description of the Related Art

Japanese Patent Laying-Open No. 2009-111197 and Japanese Patent Laying-Open No. 2009-231331 disclose one example of a stack-type inductor element of this type and a method of manufacturing the same. According to Japanese Patent Laying-Open No. 2009-111197, an adhesive film is provided on at least one surface of a sintered ferrite substrate. In addition, in order to provide a stack with a bending property, a fracture is formed in the substrate. Here, a fracture lowers permeability, however, permeability varies depending on a state of the fracture. Therefore, grooves are formed in the substrate with regularity and a fracture is formed in this groove portion. Thus, magnetic characteristics after formation of a fracture can be stabilized while a bending property is provided.

According to Japanese Patent Laying-Open No. 2009-231331, in order to divide a ceramic substrate into individual pieces of a stack, a division groove is formed in the ceramic substrate. Specifically, the division groove is formed by moving a scribing blade pressed against the other main surface of the ceramic substrate with a desired pressure. In succession, a roller pressed against one main surface of the ceramic substrate with a protection sheet being interposed is moved along the ceramic substrate. Thus, the ceramic substrate deforms to open the division groove, so that the ceramic substrate is divided along the division groove.

When a groove is formed in a substrate in a stage prior to firing, warpage is caused due to asymmetry between one main surface and the other main surface forming the substrate. This warpage may impair coplanarity of each element obtained by breakage (division into individual pieces) of the substrate and may become a factor interfering decrease in thickness.

SUMMARY OF THE INVENTION

Therefore, preferred embodiments of the present invention provide a stack-type inductor element capable of achieving a smaller thickness and a method of manufacturing the same.

A stack-type inductor element according to a preferred embodiment of the present invention includes a stack including a magnetic element layer, a coil-shaped conductor pattern provided in the stack, a plurality of first pad electrodes located on one main surface of the stack, and a plurality of second pad electrodes located on the other main surface of the stack and symmetric to the plurality of first pad electrodes, the stack has a rectangular or substantially rectangular shape when viewed in a direction of stack of the stack, and one end and the other end of the coil-shaped conductor pattern are electrically connected to two of the plurality of first pad electrodes, respectively, and the plurality of second pad electrodes are all electrically open.

Preferably, the stack has the rectangular or substantially rectangular shape when viewed in the direction of stack of the stack and the plurality of first pad electrodes are arranged in two rows along a longitudinal direction of the stack.

Preferably, the number of the first pad electrodes is three or more and a pad electrode not connected to the coil-shaped conductor pattern of the plurality of first pad electrodes is each electrically open.

Preferably, the stack includes non-magnetic element layers arranged to be superimposed on opposing main surfaces of the magnetic element layer.

A method of manufacturing a stack-type inductor element according to another preferred embodiment of the present invention is a method of manufacturing a stack-type inductor element by dividing into division units, a substrate assembly having a structure that sandwiches a magnetic element layer between a first outermost layer and a second outermost layer, including a first step of forming a plurality of first via holes passing through the first outermost layer, a second step of forming a plurality of first conductor patterns on an upper surface of the first outermost layer or a lower surface of the magnetic element layer, a third step of forming a plurality of second via holes passing through the magnetic element layer, a fourth step of forming a plurality of second conductor patterns on an upper surface of the magnetic element layer or a lower surface of the second outermost layer, a fifth step of performing an operation for forming a plurality of first pad electrodes on a lower surface of the first outermost layer and connecting two first pad electrodes to two respective points of the plurality of first conductor patterns through two first via holes for each division unit, a sixth step of forming a plurality of second pad electrodes on an upper surface of the second outermost layer so as to be symmetric to the plurality of first pad electrodes, and a seventh step of fabricating a plurality of inductors by spirally connecting the plurality of first conductor patterns and the plurality of second conductor patterns through the plurality of second via holes for each division unit.

Preferably, a ninth step of applying a blade of a scriber to a line defining the division unit and forming a groove in a longitudinal direction and a direction of a short side of the substrate assembly is further provided.

The substrate assembly preferably includes a quadrangular or substantially quadrangular main surface, and the ninth step includes the steps of forming a first groove having a first depth along a long side of the quadrangle and forming a second groove having a second depth smaller than the first depth along a short side of the quadrangle.

A tenth step of firing the substrate assembly prior to the ninth step preferably is further provided.

Preferably, the fifth step includes the step of filling the plurality of first via holes with a first conductive material, and the seventh step includes the step of filling the plurality of second via holes with a second conductive material (PS2, PS2').

Preferably, the substrate assembly has a thickness not greater than about 0.6 mm, for example.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
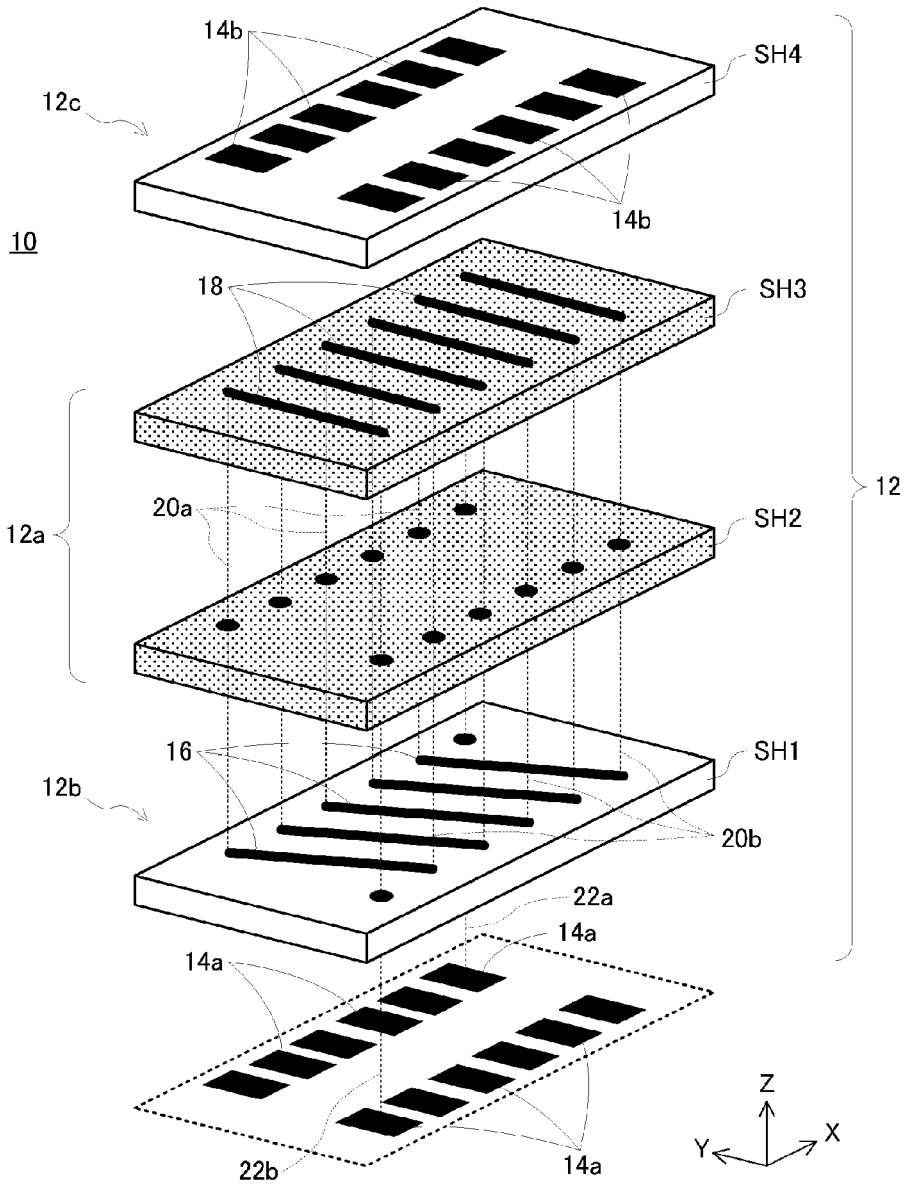
FIG. 1 is an exploded view showing a state that a stack-type inductor element according to a preferred embodiment of the present invention is disassembled.

Referring to FIG. 1, a stack-type inductor element 10 according to a preferred embodiment includes ceramic sheets SH1 to SH4 stacked such that each main surface defines a quadrangular or substantially quadrangular shape and preferably is for use as an antenna element for wireless communication in a 13.56 MHz band. Ceramic sheets SH1 to SH4 preferably are equal or substantially equal in size of each main surface. Ceramic sheets SH1 and SH4 include a non-magnetic element, whereas ceramic sheets SH2 to SH3 include a magnetic element.

Consequently, a stack 12 preferably defines a parallelepiped. Ceramic sheets SH2 to SH3 define a magnetic element layer 12*a*, ceramic sheet SH1 defines a non-magnetic element layer 12*b*, and ceramic sheet SH4 defines a non-magnetic element layer 12*c*. The stack 12 of the stack-type inductor element 10 has a stack structure such that magnetic element layer 12*a* is sandwiched between non-magnetic element layers 12*b* and 12*c*. A long side and a short side of the quadrangle defining the main surface (e.g., an upper surface or a lower surface) of stack 12 extend along an X axis and a Y axis respectively, and a thickness of stack 12 increases along a Z axis.

Figure 2A:
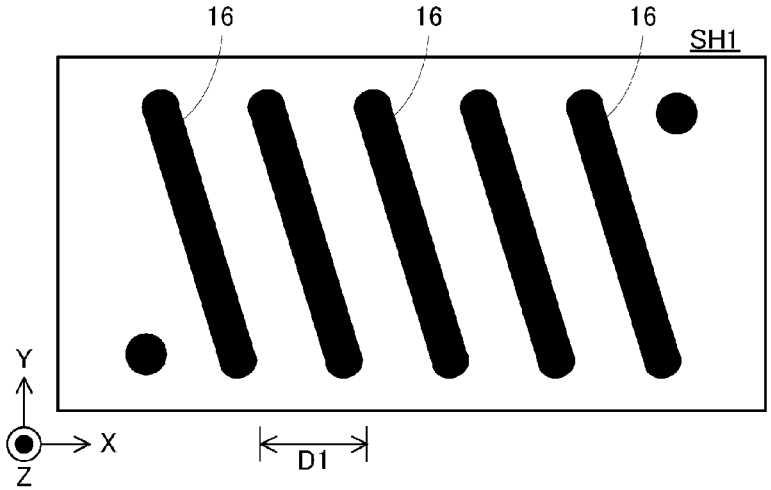
FIG. 2A is a plan view showing one example of a ceramic sheet SH1 of a stack-type inductor element and FIG. 2B is a plan view showing one example of a ceramic sheet SH3 of the stack-type inductor element.
Figure 2B:
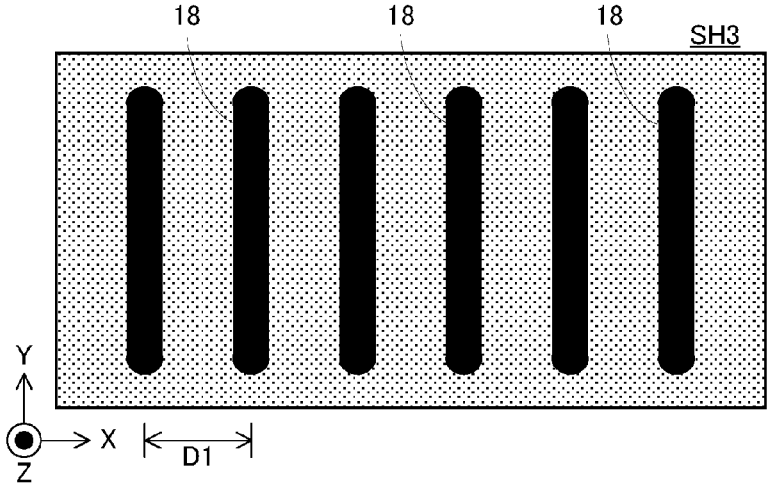
Figure 3A:
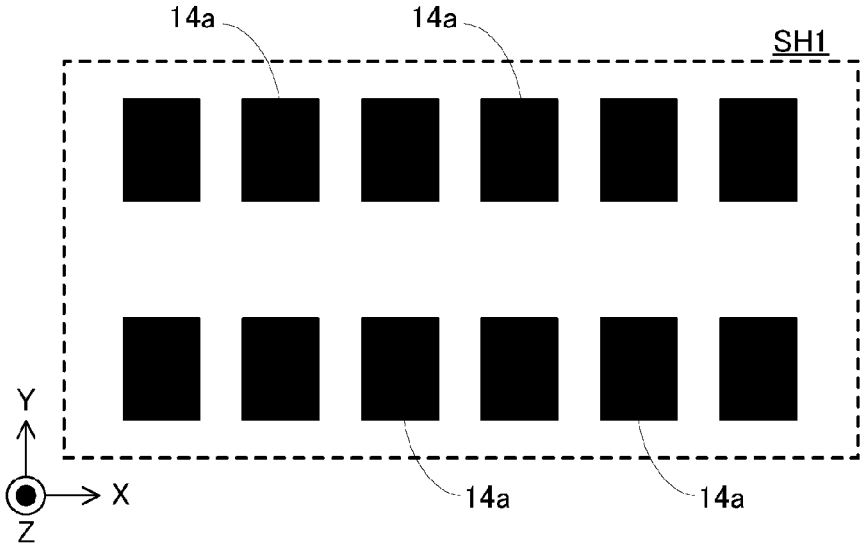
FIG. 3A is an illustrative diagram showing one example of a pad electrode located on a lower surface of ceramic sheet SH1 and FIG. 3B is a plan view showing one example of a ceramic sheet SH4 of the stack-type inductor element.
Figure 3B:
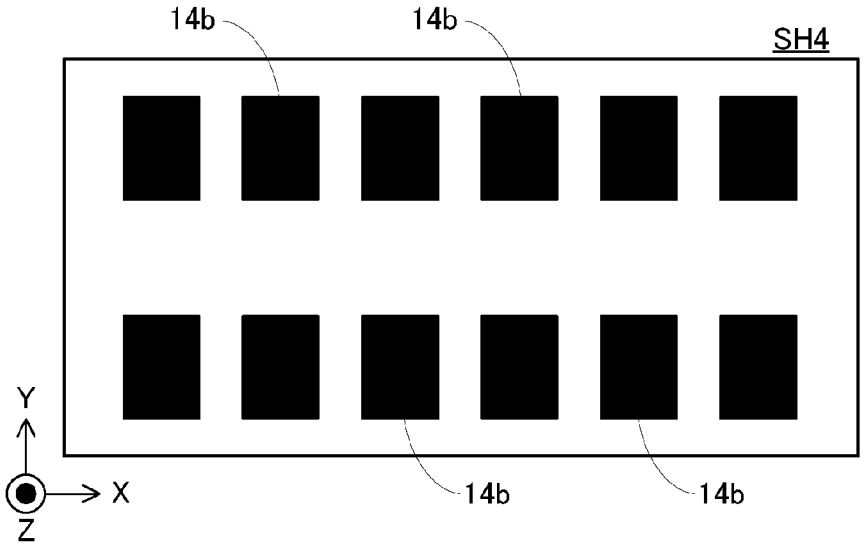

As shown in FIGS. 2A and 2B, a plurality of linear conductors are provided on an upper surface of ceramic sheet SH1, and a plurality of linear conductors 18 are provided on an upper surface of ceramic sheet SH3. In addition, as shown in FIGS. 3A and 3B, a plurality of pad electrodes 14*a* are provided on a lower surface of ceramic sheet SH1, and a plurality of pad electrodes 14*b* are provided on an upper surface of ceramic sheet SH4. It is noted that no linear conductor is present on an upper surface of ceramic sheet SH2 and a magnetic element appears over the entire upper surface.

Referring to FIG. 2A, linear conductors 16 are aligned at a distance D1 in a direction of the X axis in a position extending obliquely to the Y axis. Opposing ends in a direction of length of linear conductor 16 remain inside of opposing ends in a direction of the Y axis of the upper surface of ceramic sheet SH1. Two linear conductors 16 on opposing sides in the direction of the X axis are arranged inside of the opposing ends in the direction of the X axis of the upper surface of ceramic sheet SH1.

Referring to FIG. 2B, linear conductors 18 are aligned at distance D1 in the direction of the X axis in a position extending along the Y axis. Opposing ends in a direction of length of linear conductor 18 also remain inside of the opposing ends in the direction of the Y axis of the upper surface of ceramic sheet SH3. Two linear conductors 18 on opposing sides in the direction of the X axis are also arranged inside of the opposing ends in the direction of the X axis of the upper surface of ceramic sheet SH3.

A distance in the direction of the X axis from one end to the other end of linear conductor 16 corresponds to "D1". A position of one end of linear conductor 16 is adjusted to a position coinciding with one end of linear conductor 18 when viewed in a direction of the Z axis, and a position of the other end of linear conductor 16 is adjusted to a position coinciding with the other end of linear conductor 18 when viewed in the direction of the Z axis. The number of linear conductors 16 preferably is smaller by one than the number of linear conductors 18.

Therefore, when viewed in the direction of the Z axis, linear conductors 16 and 18 are alternately aligned in the direction of the X axis. In addition, one end of linear conductor 16 coincides with one end of linear conductor 18, and the other end of linear conductor 16 coincides with the other end of linear conductor 18.

Referring to FIG. 3A, a plurality of pad electrodes each includes a main surface that is rectangular or substantially rectangular and the pad electrodes are equal or substantially equal to one another in a size of the main surface. Some of the pad electrodes 14*a* extend at an equal or substantially equal interval along the X axis slightly inside of an end portion on a positive side in the direction of the Y axis, and the remaining pad electrodes 14*a* extend at an equal interval along the X axis slightly inside of an end portion on a negative side in the direction of the Y axis.

A distance from pad electrode 14*a* present on a most negative side in the direction of the X axis to the end portion on the negative side in the direction of the X axis of ceramic sheet SH1 is equal or substantially equal to a distance from pad electrode 14*a* present on a most positive side in the direction of the X axis to the end portion on the positive side in the direction of the X axis of ceramic sheet SH1. A distance from pad electrode 14*a* present on the most negative side in the direction of the Y axis to the end portion on the negative side in the direction of the Y axis of ceramic sheet SH1 is equal or substantially equal to a distance from pad electrode 14*a* present on the most positive side in the direction of the Y axis to the end portion on the positive side in the direction of the Y axis of ceramic sheet SH1.

Therefore, with a straight line extending along the X axis through the center in the direction of the Y axis of the main surface of ceramic sheet SH1 being defined as the reference, the pad electrodes 14*a* on the negative side in the direction of the Y axis relative to the straight line are in line symmetry to the pad electrodes 14*a* on the positive side in the direction of the Y axis relative to the straight line.

With a straight line extending along the Y axis through the center in the direction of the X axis of the main surface of ceramic sheet SH1 being defined as the reference, the pad electrodes 14*a* on the negative side in the direction of the X axis relative to the straight line are in line symmetry to the pad electrodes 14*a* on the positive side in the direction of the X axis relative to this straight line.

Referring to FIG. 3B, the pad electrodes 14*b* each preferably include a rectangular or substantially rectangular main surface and are equal or substantially equal to one another in a size of the main surface. Among these, some of the pad electrodes 14*b* extend at an equal or substantially equal interval along the X axis slightly inside of an end portion on a positive side in the direction of the Y axis, and the remaining pad electrodes 14*b* extend at an equal or substantially equal interval along the X axis slightly inside of an end portion on a negative side in the direction of the Y axis.

A distance from pad electrode 14*b* present on a most negative side in the direction of the X axis to the end portion on the negative side in the direction of the X axis of ceramic sheet SH4 is equal or substantially equal to a distance from pad electrode 14*b* present on a most positive side in the direction of the X axis to the end portion on the positive side in the direction of the X axis of ceramic sheet SH4. A distance from pad electrode 14*b* present on the most negative side in the direction of the Y axis to the end portion on the negative side in the direction of the Y axis of ceramic sheet SH4 is equal or substantially equal to a distance from pad electrode 14*b* present on the most positive side in the direction of the Y axis to the end portion on the positive side in the direction of the Y axis of ceramic sheet SH4.

Therefore, with a straight line extending along the X axis through the center in the direction of the Y axis of the main surface of ceramic sheet SH4 being defined as the reference, the pad electrodes 14*b* on the negative side in the direction of the Y axis relative to the straight line are in line symmetry to six pad electrodes 14*b* on the positive side in the direction of the Y axis relative to the straight line.

With a straight line extending along the Y axis through the center in the direction of the X axis of the main surface of ceramic sheet SH4 being defined as the reference, the pad electrodes 14*b* on the negative side in the direction of the X axis relative to the straight line are in line symmetry to the pad electrodes 14*b* on the positive side in the direction of the X axis relative to the straight line.

A size of the main surface of pad electrode 14*b* is also the same as a size of the main surface of pad electrode 14*a*, and a manner of arrangement of pad electrodes 14*b* at the main surface of ceramic sheet SH4 is the same as a manner of arrangement of pad electrodes 14*a* at the main surface of ceramic sheet SH1. Therefore, pad electrodes 14*b* are in mirror symmetry with pad electrodes 14*a*. When viewed in the direction of the Z axis, opposing ends of each linear conductor 18 coincide with two pad electrodes 14*a* aligned along the Y axis, and further coincide also with two pad electrodes 14*b* aligned along the Y axis.

Referring back to FIG. 1, via hole conductors 20*a* pass through magnetic element layer 12*a* in the direction of the Z axis at a position of one end of linear conductors 16 (the end portion on the positive side in the direction of the Y axis). Via hole conductors 20*b* pass through magnetic element layer 12*a* in the direction of the Z axis at a position of the other end of linear conductors 16 (the end portion on the negative side in the direction of the Y axis).

Linear conductors 16 are arranged as shown in FIG. 2A, and linear conductors 18 are arranged as shown in FIG. 2B. Therefore, via hole conductors 20*a* are connected to first ends (the end portion on the positive side in the direction of the Y axis) of linear conductors 18 starting from the negative side in the direction of the X axis at the upper surface of ceramic sheet SH3. Via hole conductors 20*b* are connected to second ends (the end portion on the negative side in the direction of the Y axis) of linear conductors 18 starting from the positive side in the direction of the X axis at the upper surface of ceramic sheet SH3.

Consequently, linear conductors 16 and linear conductors 18 are spirally connected, and thus, a coil conductor (a wound element) having the X axis as an axis of winding is provided. Since a magnetic element is present inside the coil conductor, the coil conductor defines and functions as an inductor.

A via hole conductor 22*a* passes through magnetic element layer 12*a* and non-magnetic element layer 12*b* in the direction of the Z axis at a position of one end of linear conductor 18 present on the most positive side in the direction of the X axis. Similarly, a via hole conductor 22*b* passes through magnetic element layer 12*a* and non-magnetic element layer 12*b* in the direction of the Z axis at a position of the other end of linear conductor 18 present on the most negative side in the direction of the X axis.

Via hole conductor 22*a* is connected to pad electrode 14*a* present on the most positive side in the direction of the X axis and on the positive side in the direction of the Y axis. Via hole conductor 22*b* is connected to pad electrode 14*a* present on the most negative side in the direction of the X axis and on the negative side in the direction of the Y axis. Thus, two different points of the inductor are connected to two pad electrodes 14*a* and 14*a*, respectively.

Figure 4:
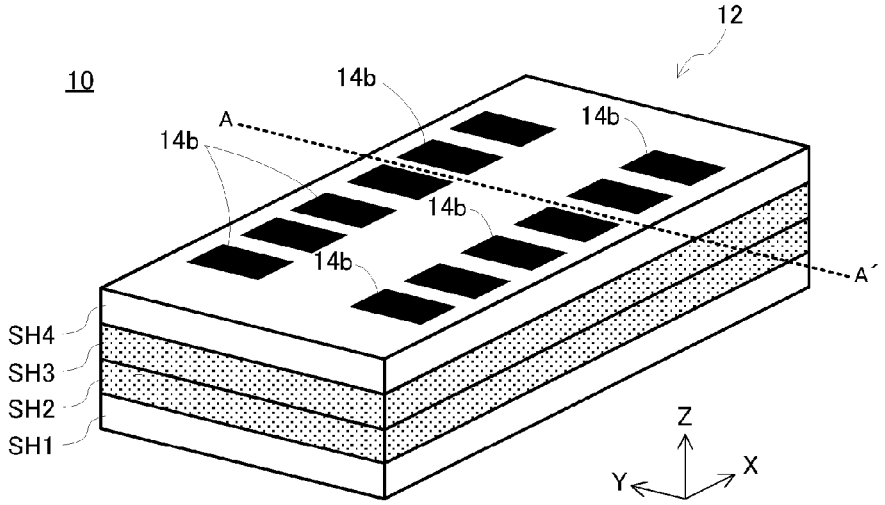
FIG. 4 is a perspective view showing an appearance of the stack-type inductor element according to a preferred embodiment of the present invention.
Figure 5:
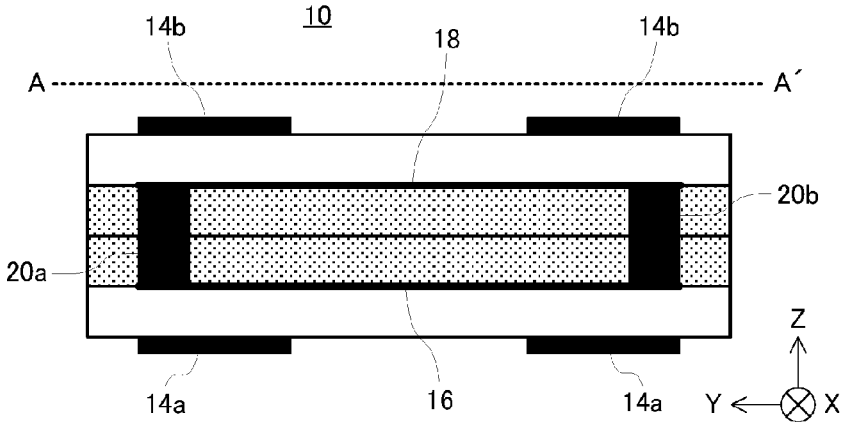
FIG. 5 is a cross-sectional view along A-A' of the stack-type inductor element shown in FIG. 4.
Figure 6A:
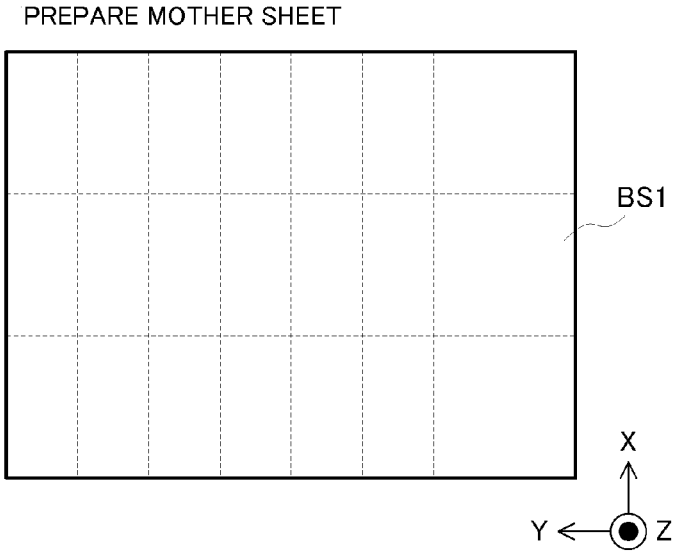
FIG. 6A is a process chart showing a portion of a process for manufacturing ceramic sheet SH1 and FIG. 6B is a process chart showing another portion of the process for manufacturing ceramic sheet SH1.
Figure 6B:
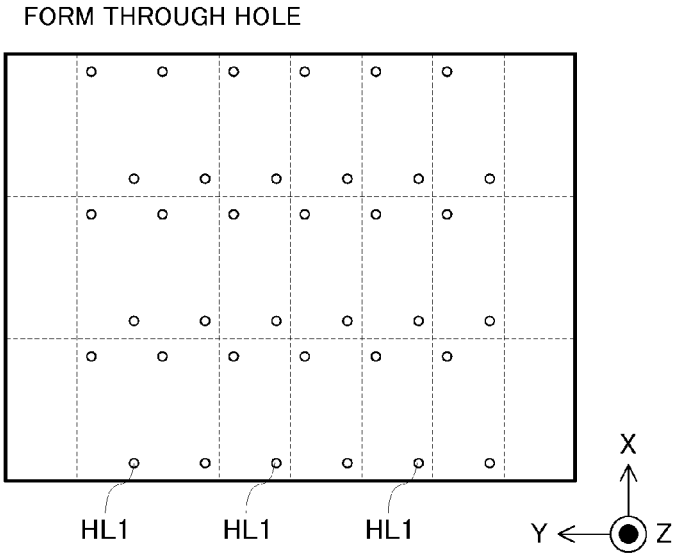

Stack 12, that is, stack-type inductor element 10, thus fabricated has an appearance shown in FIG. 4. A cross-section along A-A' of this stack-type inductor element 10 has a structure shown in FIG. 5.

It is noted that ceramic sheets SH1 and SH4 preferably are made of a non-magnetite ferrite material (relative permeability: 1) and exhibit a value for coefficient of thermal expansion in a range from about 8.5 to about 9.0, for example. Ceramic sheets SH2 to SH3 preferably are made of a magnetite ferrite material (relative permeability: 100 to 120) and exhibit a value for coefficient of thermal expansion in a range from about 9.0 to about 10.0, for example. Pad electrodes 14*a* and 14*b*, linear conductors 16 and 18, and via hole conductors 20*a* to 20*b* and 22*a* to 22*b* preferably are made of a silver material and exhibit a coefficient of thermal expansion of about 20, for example.

Ceramic sheet SH1 preferably is fabricated in a manner shown in FIGS. 6A, 6B, 7A and 7B. Initially, a ceramic green sheet made of a non-magnetic ferrite material is prepared as a mother sheet BS1 (see FIG. 6A). Here, a plurality of dashed lines extending in the direction of the X axis and the direction of the Y axis show cutting positions. Each of a plurality of rectangles defined by these dashed lines is defined as a "division unit".

Figure 7A:
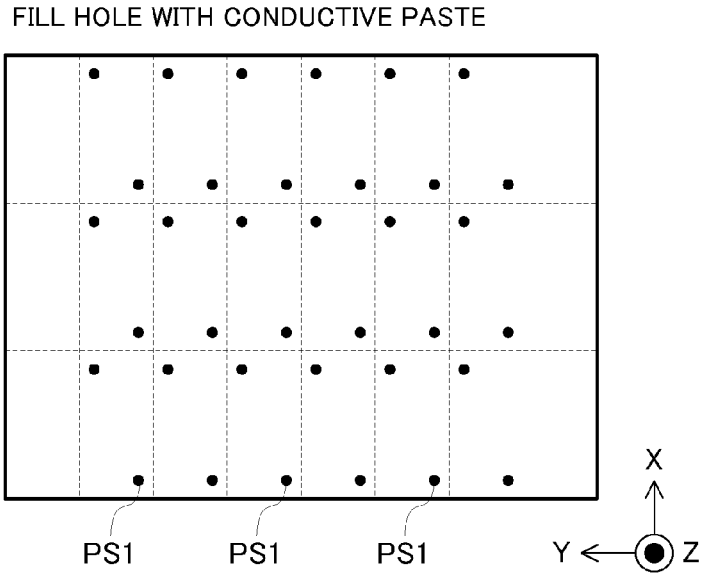
FIG. 7A is a process chart showing still another portion of the process for manufacturing ceramic sheet SH1 and FIG. 7B a process chart showing yet another portion of the process for manufacturing ceramic sheet SH1.

Then, a plurality of through holes HL1 are formed in mother sheet BS1 in correspondence with the vicinity of an intersection of the dashed lines (see FIG. 6B), and through hole HL1 is filled with a conductive paste PS1 (see FIG. 7A). Conductive paste PS1 forms via hole conductor 22*a* or 22*b*. When filling with conductive paste PS1 is completed, a conductor pattern corresponding to linear conductors 16 is printed on an upper surface of mother sheet BS1 (see FIG. 7B).

Figure 8A:
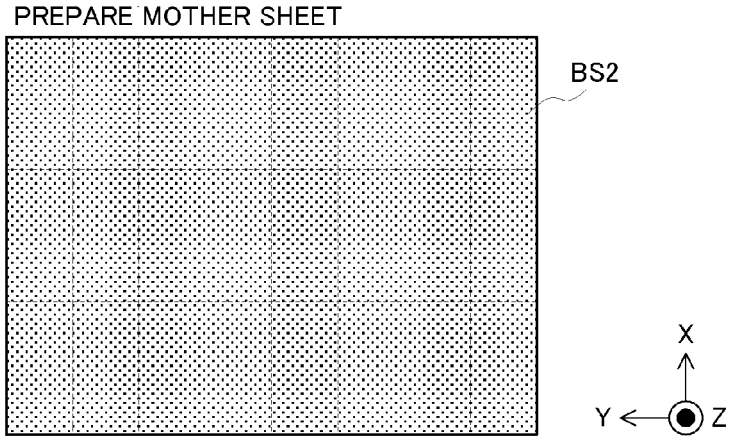
FIG. 8A is a process chart showing a portion of a process for manufacturing a ceramic sheet SH2.
Figure 8B:
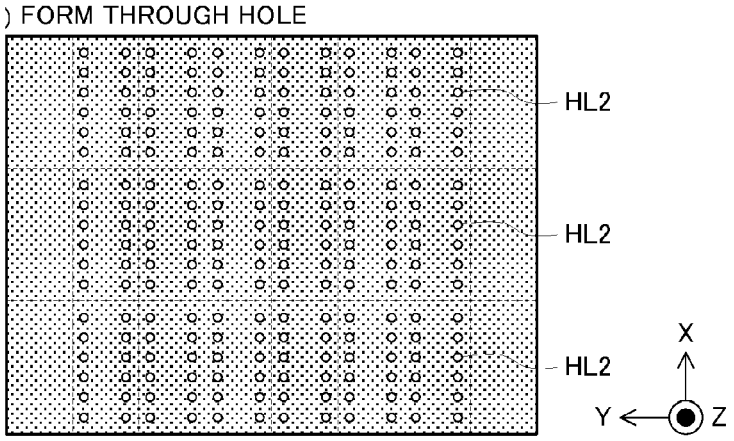
FIG. 8B is a process chart showing another portion of the process for manufacturing ceramic sheet SH2.
Figure 8C:
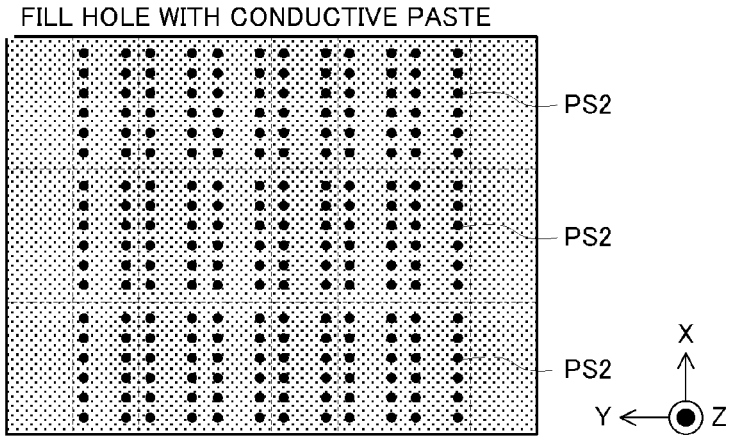
FIG. 8C is a process chart showing still another portion of the process for manufacturing ceramic sheet SH2.
Figure 9A:
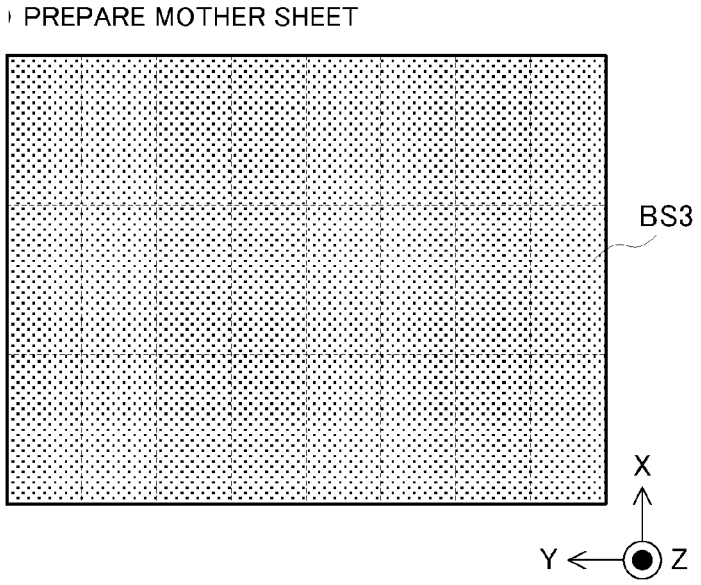
FIG. 9A is a process chart showing a portion of a process for manufacturing ceramic sheet SH3 and FIG. 9B is a process chart showing another portion of the process for manufacturing ceramic sheet SH3.
Figure 9B:
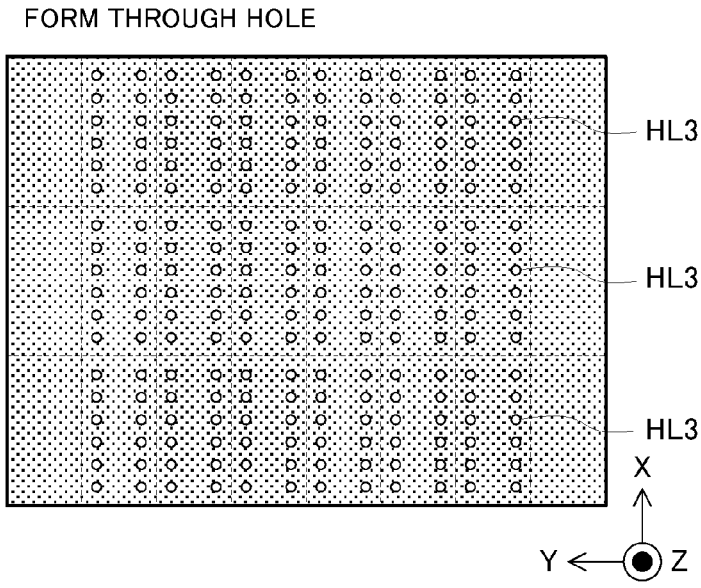

Ceramic sheet SH2 preferably is fabricated in a manner shown in FIGS. 8A to 8C. Initially, a ceramic green sheet made of a magnetic ferrite material is prepared as a mother sheet BS2 (see FIG. 8A). Here, a plurality of dashed lines extending in the direction of the X axis and the direction of the Y axis show cutting positions. Then, a plurality of through holes HL2 are formed in mother sheet BS2 along the dashed lines extending in the direction of the X axis (see FIG. 8B), and through hole HL2 is filled with a conductive paste PS2 forming via hole conductors 20*a*, 20*b*, 22*a*, or 22*b* (see FIG. 8C).

Ceramic sheet SH3 preferably is fabricated in a manner shown in FIGS. 9A-9C and FIGS. 10A and 10B. Initially, a ceramic green sheet made of a magnetic ferrite material is prepared as a mother sheet BS3 (see FIG. 9A). Here, a plurality of dashed lines extending in the direction of the X axis and the direction of the Y axis show cutting positions.

Figure 10A:
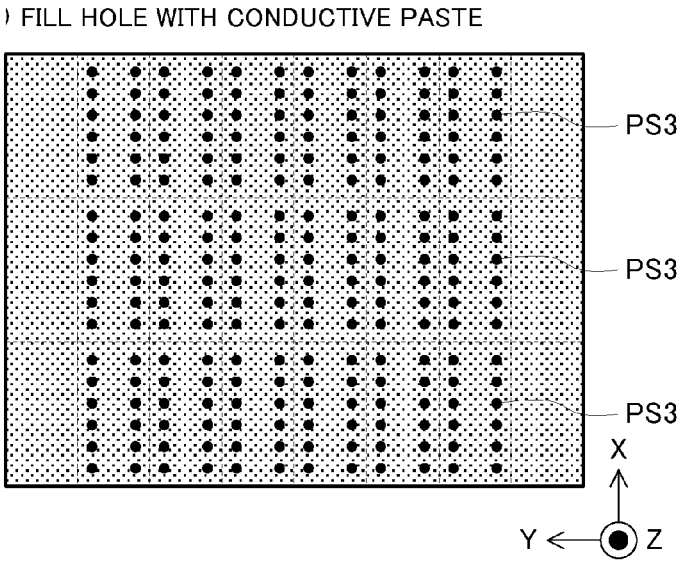
FIG. 10A is a process chart showing still another portion of the process for manufacturing ceramic sheet SH3 and FIG. 10B is a process chart showing yet another portion of the process for manufacturing ceramic sheet SH3.
Figure 10B:
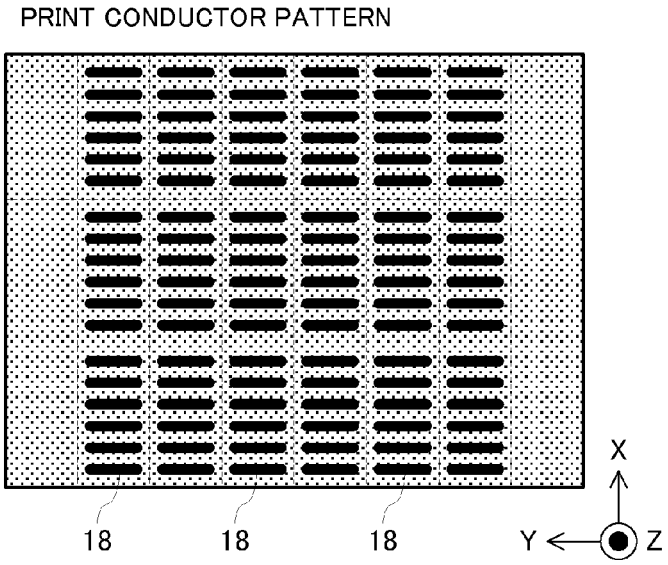

Then, a plurality of through holes HL3 are formed in mother sheet BS3 along the dashed lines extending in the direction of the X axis (see FIG. 9B), and through hole HL3 is filled with a conductive paste PS3 (see FIG. 10A). Conductive paste PS3 forms via hole conductors 20*a*, 20*b*, 22*a*, or 22*b*. When filling with conductive paste PS3 is completed, a conductor pattern corresponding to linear conductors 18 is printed on an upper surface of mother sheet BS3 (see FIG. 10B).

Figure 11A:
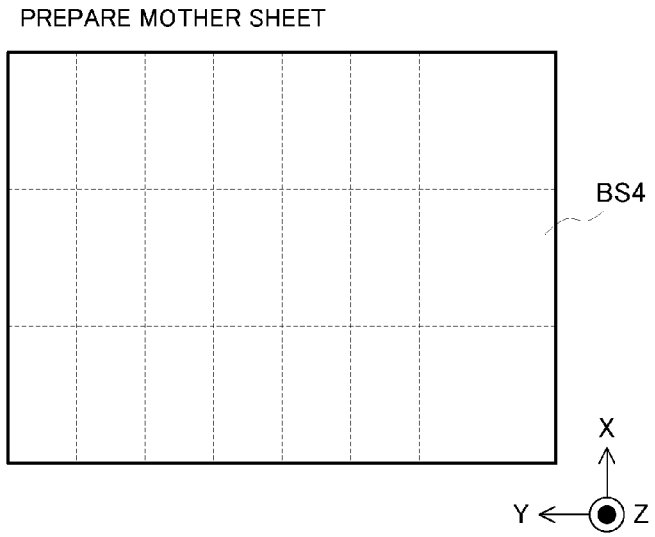
FIG. 11A is a process chart showing a portion of a process for manufacturing ceramic sheet SH4 and FIG. 11B is a process chart showing another portion of the process for manufacturing ceramic sheet SH4.
Figure 11B:
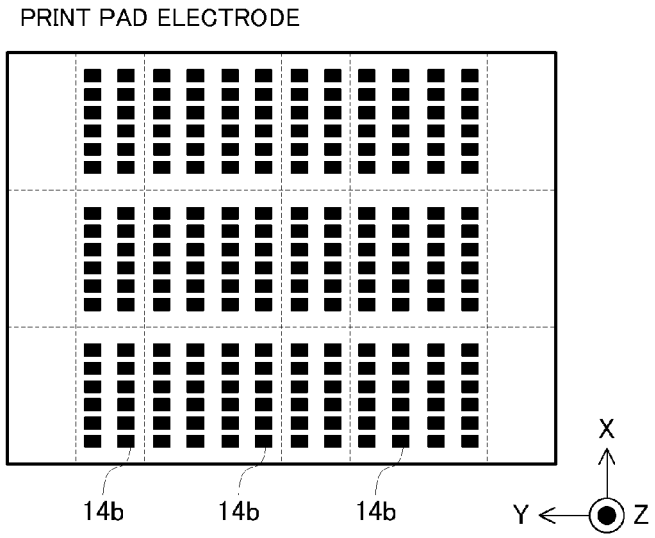

Ceramic sheet SH4 preferably is fabricated in a manner shown in FIGS. 11A and 11B. Initially, a ceramic green sheet made of a non-magnetic ferrite material is prepared as a mother sheet BS4 (see FIG. 11A). Here, a plurality of dashed lines extending in the direction of the X axis and the direction of the Y axis show cutting positions. Then, a conductor pattern corresponding to pad electrodes 14*b* is printed on an upper surface of mother sheet BS4 (see FIG. 11B).

Figure 12:
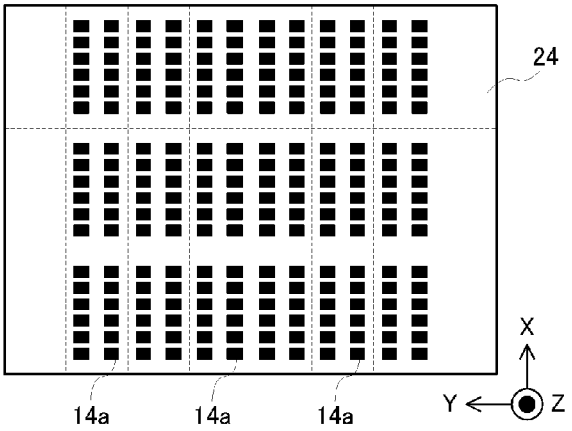
FIG. 12 is a plan view showing one example of a carrier film on which a pad electrode is printed.

The conductor pattern corresponding to pad electrodes 14*a* is printed on a carrier film 24 in a manner shown in FIG. 12. A size of a main surface of carrier film 24 is the same as a size of the main surface of mother sheets BS1 to BS4. A plurality of dashed lines extending in the direction of the X axis and the direction of the Y axis correspond to a plurality of dashed lines drawn on mother sheets BS1 to BS4.

Figure 13A:
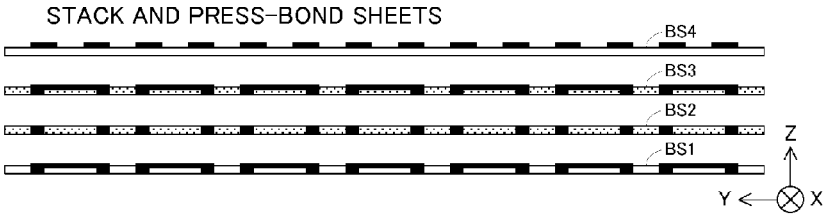
FIG. 13A is a process chart showing a portion of a process for manufacturing a stack-type inductor element.
Figure 13B:
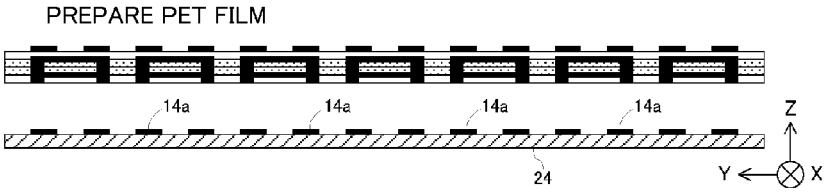
FIG. 13B is a process chart showing another portion of the process for manufacturing a stack-type inductor element, and FIG. 13C a process chart showing still another portion of the process for manufacturing a stack-type inductor element.

Mother sheets BS1 to BS4 created in the manner described above are stacked and press-bonded in this order (see FIG. 13A). Here, a position of stack of each sheet is adjusted such that dashed lines allocated to each sheet coincide when viewed in the direction of the Z axis. In succession, carrier film 24 shown in FIG. 12 is prepared (see FIG. 13B) and a conductor pattern formed on carrier film 24 is transferred to the lower surface of mother sheet BS1 (see FIG. 13C).

Figure 14A:
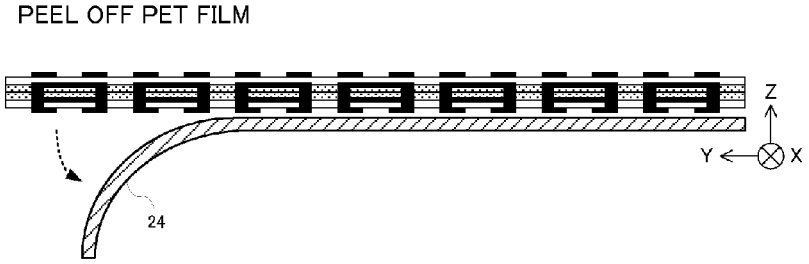
FIG. 14A is a process chart showing yet another portion of the process for manufacturing a stack-type inductor element.
Figure 14B:
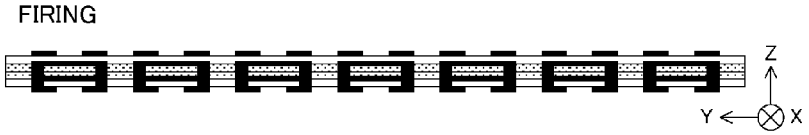
FIG. 14B is a process chart showing another portion of the process for manufacturing a stack-type inductor element.
Figure 14C:
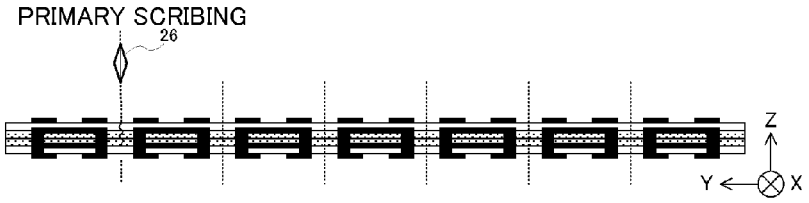
FIG. 14C is a process chart showing still another portion of the process for manufacturing a stack-type inductor element.
Figure 14D:
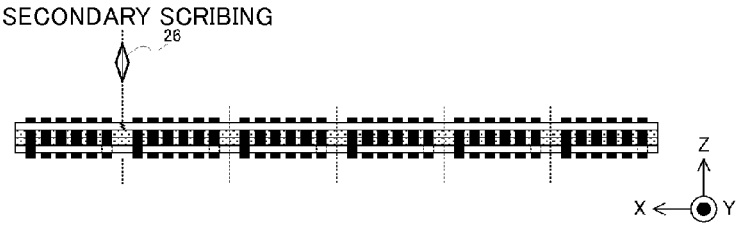
FIG. 14D is a process chart showing yet another portion of the process for manufacturing a stack-type inductor element.

As transfer of the conductor pattern is completed, carrier film 24 is peeled off (see FIG. 14A), and an unprocessed substrate assembly is fabricated. A thickness of the fabricated substrate assembly preferably is reduced to about 0.4 mm or smaller, for example. The fabricated substrate assembly is fired (see FIG. 14B) and thereafter subjected to primary scribing and secondary scribing (see FIGS. 14C and 14D).

In primary scribing, a blade of a scriber 26 is applied along the dashed line extending in the direction of the X axis, and in secondary scribing, the blade of scriber 26 is applied along the dashed line extending in the direction of the Y axis. In any of primary scribing and secondary scribing, a groove is formed in an upper surface of the substrate assembly. It is noted that a groove formed in primary scribing reaches non-magnetic element layer 12*b*, whereas a groove formed in secondary scribing reaches only magnetic element layer 12*a*. This is a groove made by a prior crack which was caused by adjusting a blade pressure at the time of application of the blade of scriber 26 and intentionally adjusting a depth. As scribing is completed, the substrate assembly is broken into division units, to thus obtain a plurality of stack-type inductor elements 10.

As is clear from the description above, stack 12 includes magnetic element layer 12*a* and non-magnetic element layers 12*b* and 12*c* provided on respective opposing main surfaces thereof. Linear conductors 16 and 18 define a portion of an inductor having a longitudinal direction of stack 12 as an axis of winding and are provided on opposing main surfaces of magnetic element layer 12*a*. Pad electrodes 14*a* are provided on the upper surface of stack 12, and pad electrodes 14*b* are provided on the lower surface of stack 12 so as to be symmetric to pad electrodes 14*a*. Two different points of the inductor are electrically connected to two different pad electrodes 14*a* and 14*a*, respectively.

Stack-type inductor element 10 is manufactured by breaking a substrate assembly having such a structure that magnetic mother sheets BS2 and BS3 are sandwiched between non-magnetic mother sheets BS1 and BS4 into division units. The substrate assembly is fabricated in a manner below.

Figure 7B:
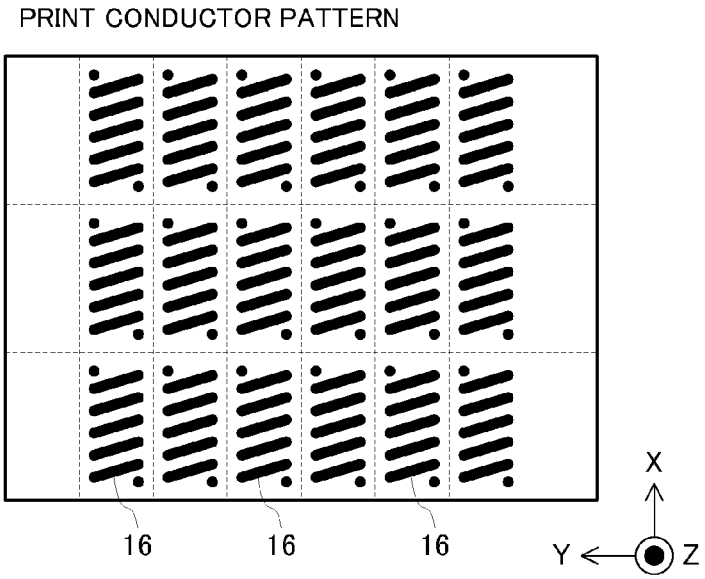

Initially, through holes HL1 extending in the direction of the Z axis are formed in mother sheet BS1 (see FIG. 6B), and a conductor pattern corresponding to linear conductors 16 is formed on the upper surface of mother sheet BS1 (see FIG. 7B). In addition, through holes HL2 extending in the direction of the Z axis are formed in mother sheet BS2 (see FIG. 8B), through holes HL3 extending in the direction of the Z axis are formed in mother sheet BS3 (see FIG. 9B), and a conductor pattern corresponding to linear conductors 18 is formed on the upper surface of mother sheet BS3 (see FIG. 10B).

Figure 13C:
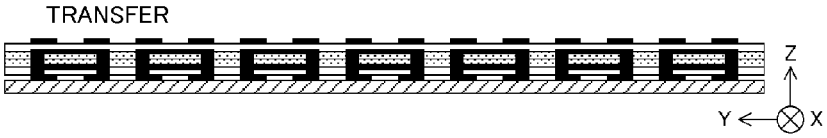

Carrier film 24 on which a plurality of pad electrodes 14*a* are printed is prepared on the lower surface of mother sheet BS1, and two pad electrodes 14*a* and 14*a* defining each division unit are connected to two points of linear conductors 16 and 16 through two corresponding through holes HL1 and HL1, respectively (see FIG. 13C). It is noted that pad electrodes 14*b* are provided on the upper surface of mother sheet BS4 so as to be symmetric to pad electrodes 14*a* (see FIG. 11B). The inductor is formed by spirally connecting linear conductors 16 and 18 for each division unit through through holes HL2 and HL3 (see FIG. 13A).

The substrate assembly thus fabricated is subjected to primary scribing and secondary scribing after firing (see FIGS. 14B to 14D), and broken along grooves formed by such scribing.

In the fired substrate assembly, residual stress originating from a difference in coefficient of thermal expansion between a material forming pad electrodes 14*a* and 14*b* and linear conductors 16 and 18 and a material forming magnetic element layer 12*a* or non-magnetic element layers 12*b* and 12*c* is caused. It is noted that pad electrodes 14*a* and 14*b* provided on the opposing main surfaces of stack 12 preferably are mirror symmetric to each other in this preferred embodiment. Therefore, warpage of the substrate assembly originating from residual stress is significantly reduced or prevented and stack-type inductor element 10 obtained by breakage is smaller in thickness.

It is noted that decrease in thickness is suitable for a case that stack-type inductor element 10 is contained in an SIM card or a micro SIM card together with a secure IC for NFC (Near Field Communication).

Since residual stress is generated, a breakage line extends in a direction of thickness of stack 12 so as to go around pad electrodes 14*a* and 14*b*. Thus, defective breakage is significantly reduced or prevented.

Furthermore, since no groove is present in a stage prior to firing, a magnetic element layer is not exposed and precipitation of plating onto a magnetic element layer is avoided. By making use of dummy pad electrode 14*a* (pad electrode 14*a* not connected to an inductor) during mounting of stack-type inductor element 10 on a printed board, the number of points of contact between stack-type inductor element 10 and the printed board increases. Thus, fall strength or bending strength of stack-type inductor element 10 is significantly improved.

Figure 15A:
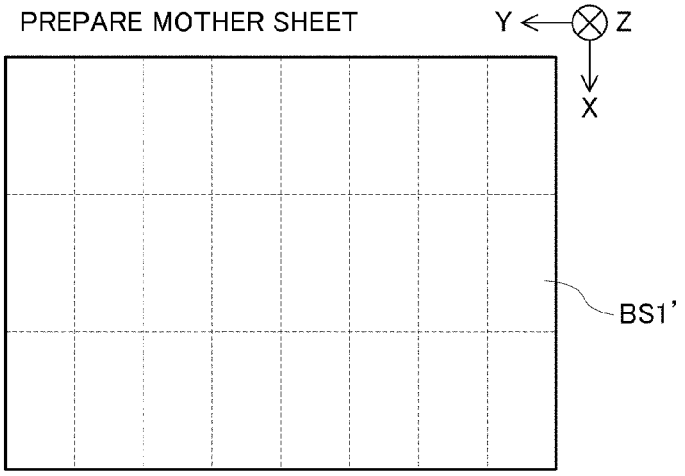
FIG. 15A is a process chart showing a portion of a process for manufacturing ceramic sheet SH1 in another preferred embodiment of the present invention and FIG. 15B is a process chart showing another portion of the process for manufacturing ceramic sheet SH1 in another preferred embodiment of the present invention.
Figure 15B:
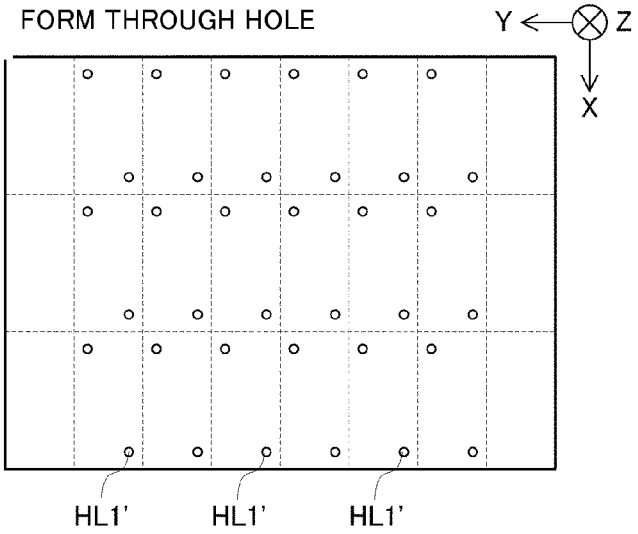

A method of manufacturing stack-type inductor element in another preferred embodiment will be described. Ceramic sheet SH1 is fabricated in a manner shown in FIGS. 15A, 15B, 16A and 16B. Initially, a ceramic green sheet made of a non-magnetic ferrite material is prepared as a mother sheet BS1' (see FIG. 15(A)). Here, a plurality of dashed lines extending in the direction of the X axis and the direction of the Y axis show cutting positions.

Figure 16A:
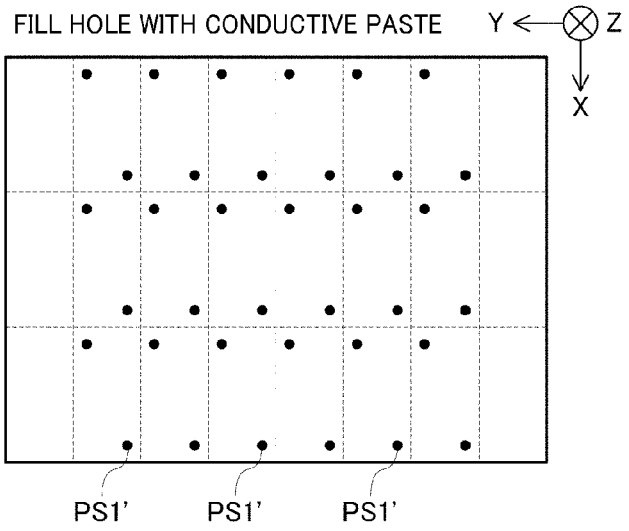
FIG. 16A is a process chart showing still another portion of the process for manufacturing ceramic sheet SH1 in another preferred embodiment of the present invention and FIG. 16B is a process chart showing yet another portion of the process for manufacturing ceramic sheet SH1 in another preferred embodiment of the present invention.
Figure 16B:
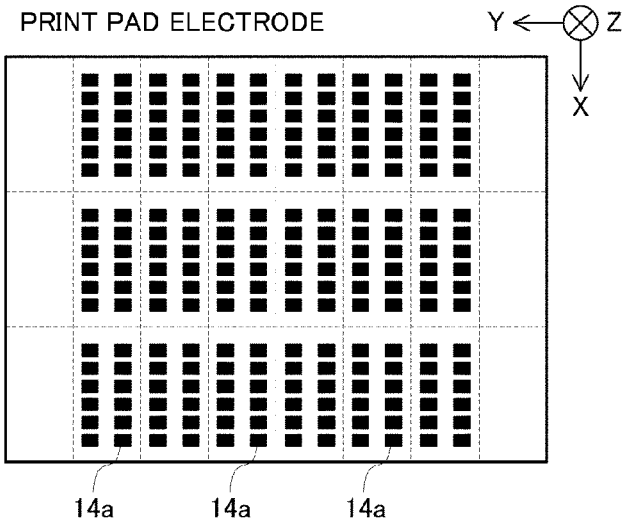
Figure 17A:
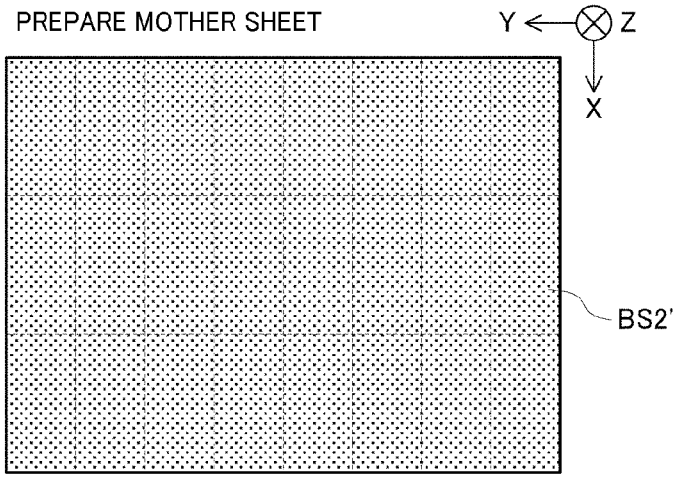
FIG. 17A is a process chart showing a portion of a process for manufacturing ceramic sheet SH2 in another preferred embodiment of the present invention and FIG. 17B is a process chart showing another portion of the process for manufacturing ceramic sheet SH2 in another preferred embodiment of the present invention.
Figure 17B:
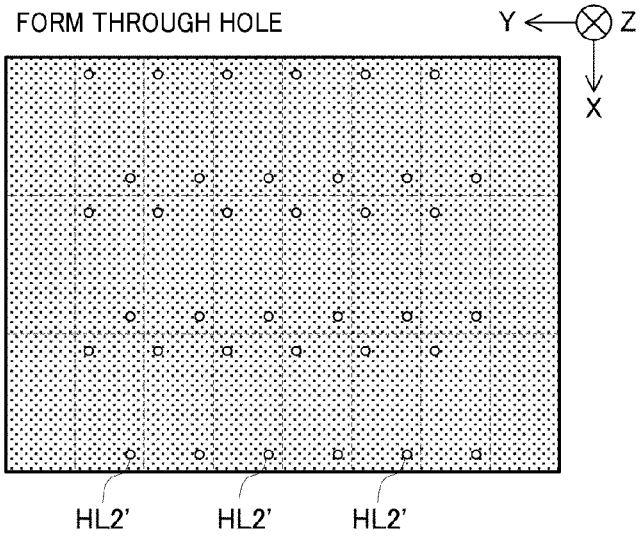
Figure 18A:
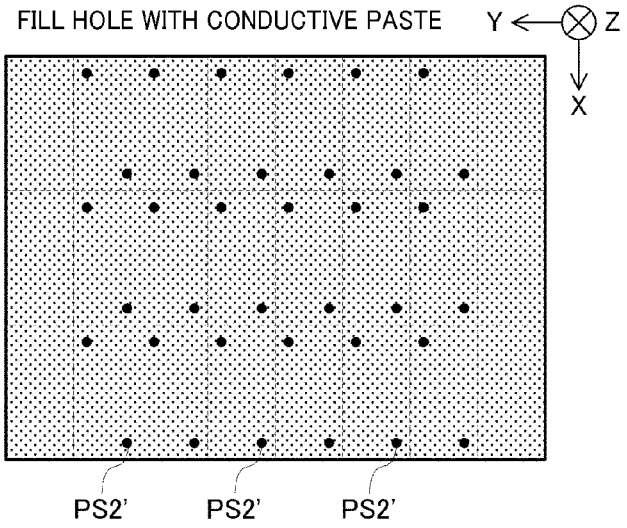
FIG. 18A is a process chart showing still another portion of the process for manufacturing ceramic sheet SH2 in another preferred embodiment of the present invention and FIG. 18B is a process chart showing yet another portion of the process for manufacturing ceramic sheet SH2 in another preferred embodiment of the present invention.
Figure 18B:
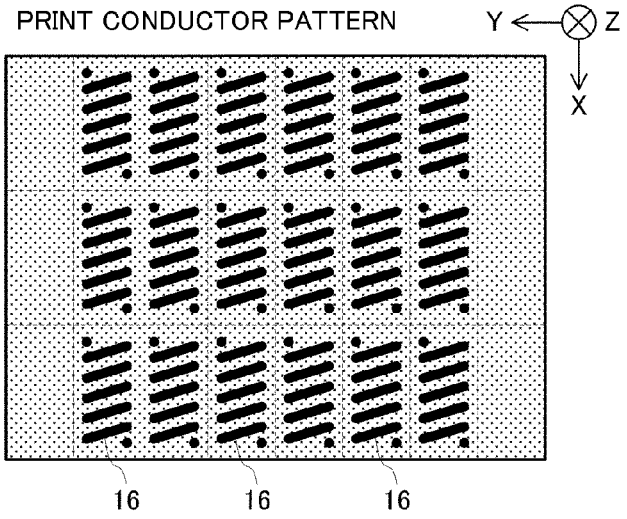
Figure 19A:
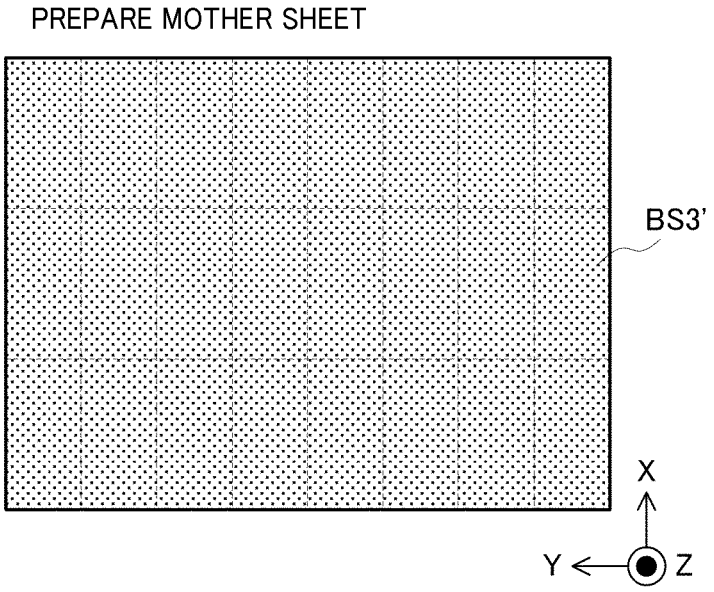
FIG. 19A is a process chart showing a portion of a process for manufacturing ceramic sheet SH3 in another preferred embodiment of the present invention and FIG. 19B is a process chart showing another portion of the process for manufacturing ceramic sheet SH3 in another preferred embodiment of the present invention.
Figure 19B:
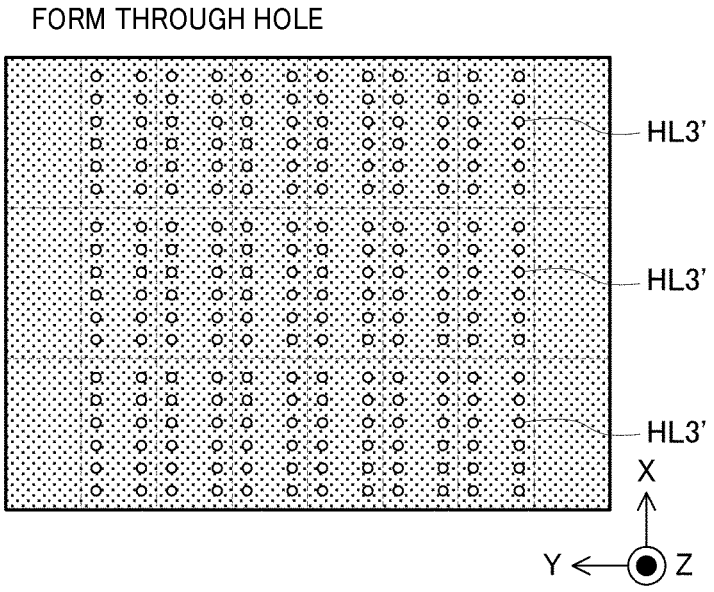

Then, a plurality of through holes HL1' are formed in mother sheet BS1' in correspondence with the vicinity of an intersection of the dashed lines (see FIG. 15B), and through hole HL1' is filled with a conductive paste PS1' (see FIG. 16A). Conductive paste PS1' forms via hole conductor 22*a* or 22*b*. When filling with conductive paste PS1' is completed, a conductor pattern corresponding to pad electrodes 14*a* is printed on a lower surface of mother sheet BS1' (see FIG. 16B).

Ceramic sheet SH2 is fabricated in a manner shown in FIGS. 17A, 17B, 18A, and 18B. Initially, a ceramic green sheet made of a magnetic ferrite material is prepared as a mother sheet BS2' (see FIG. 17A). Here, a plurality of dashed lines extending in the direction of the X axis and the direction of the Y axis show cutting positions. Then, a plurality of through holes HL2' are formed in mother sheet BS2' along a dashed line extending in the direction of the X axis (see FIG. 17B), and through hole HL2' is filled with a conductive paste PS2' forming via hole conductors 20*a*, 20*b*, 22*a*, or 22*b* (see FIG. 18A). When filling with conductive paste PS2' is completed, a conductor pattern corresponding to linear conductors 16 is printed on a lower surface of mother sheet BS2' (see FIG. 18B).

Ceramic sheet SH3 preferably is fabricated in a manner shown in FIGS. 19A, 19B, 20A and 20B. Initially, a ceramic green sheet made of a magnetic ferrite material is prepared as a mother sheet BS3' (see FIG. 19A). Here, a plurality of dashed lines extending in the direction of the X axis and the direction of the Y axis show cutting positions.

Figure 20A:
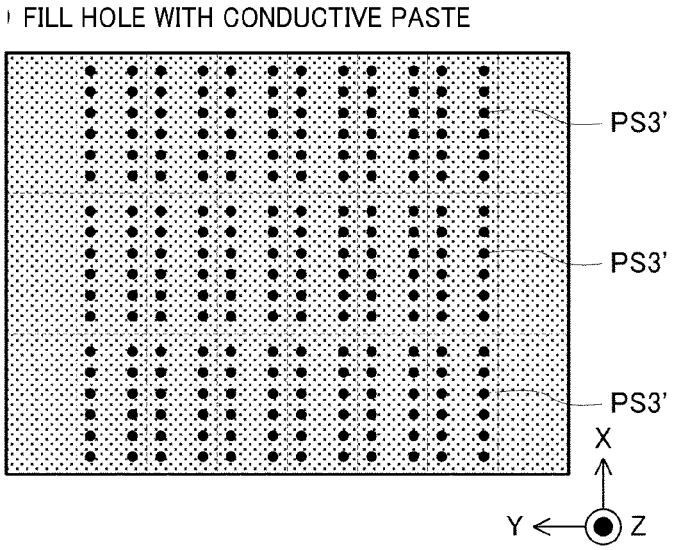
FIG. 20A is a process chart showing still another portion of the process for manufacturing ceramic sheet SH3 in another preferred embodiment of the present invention and FIG. 20B is a process chart showing yet another portion of the process for manufacturing ceramic sheet SH3 in another preferred embodiment of the present invention.
Figure 20B:
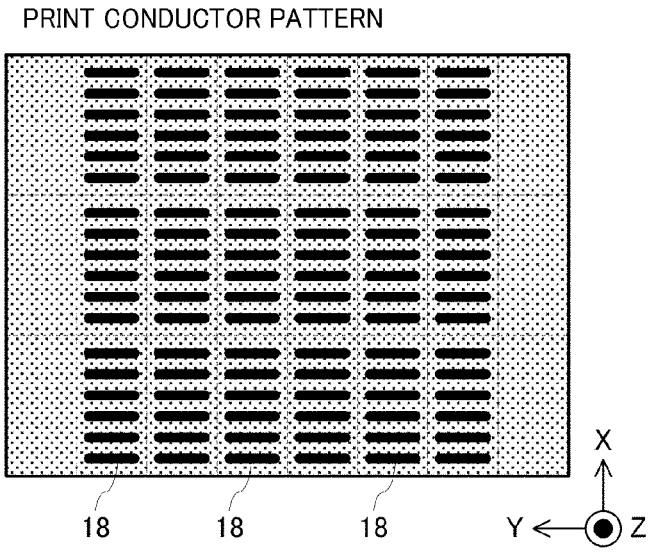

Then, a plurality of through holes HL3' are formed in mother sheet BS3' along the dashed line extending in the direction of the X axis (see FIG. 19B), and through hole HL3' is filled with a conductive paste PS3' (see FIG. 20A). Conductive paste PS3' forms via hole conductors 20*a*, 20*b*, 22*a*, or 22*b*. When filling with conductive paste PS3' is completed, a conductor pattern corresponding to linear conductors 18 is printed on an upper surface of mother sheet BS3' (see FIG. 20B).

Figure 21A:
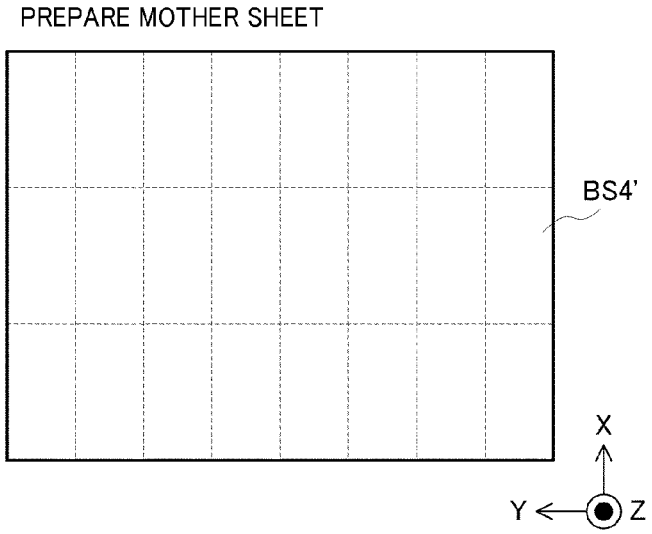
FIG. 21A is a process chart showing a portion of a process for manufacturing ceramic sheet SH4 in another preferred embodiment of the present invention and FIG. 21B is a process chart showing another portion of the process for manufacturing ceramic sheet SH4 in another preferred embodiment.
Figure 21B:
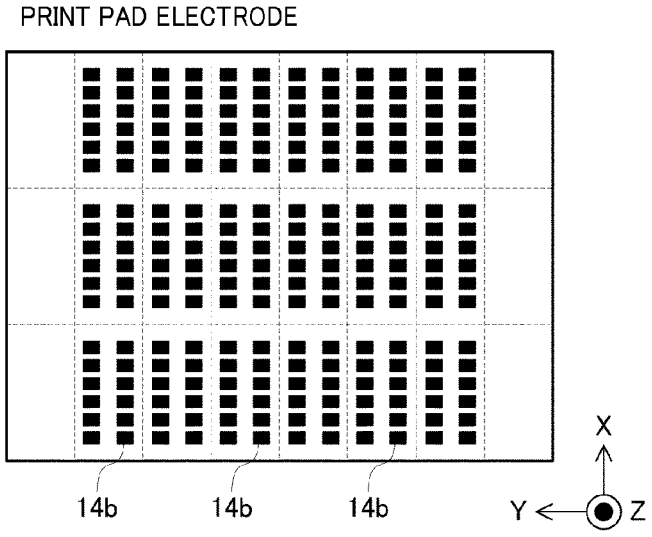

Ceramic sheet SH4 preferably is fabricated in a manner shown in FIGS. 21A and 21B. Initially, a ceramic green sheet made of a non-magnetic ferrite material is prepared as a mother sheet BS4' (see FIG. 21A). Here, a plurality of dashed lines extending in the direction of the X axis and the direction of the Y axis show cutting positions. Then, a conductor pattern corresponding to pad electrodes 14*b* is printed on an upper surface of mother sheet BS4' (see FIG. 21B).

Figure 22A:
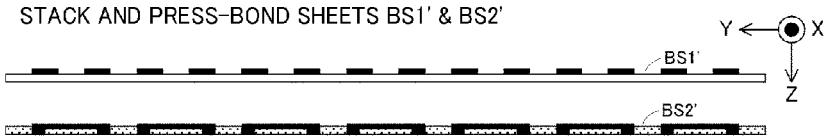
FIG. 22A is a process chart showing a portion of a process for manufacturing a stack-type inductor element in another preferred embodiment of the present invention.

Mother sheets BS1' and BS2' are stacked and press-bonded in such a position that a lower surface of mother sheet BS2' faces the upper surface of mother sheet BS1' (see FIG. 22A). Here, a position of stack of each sheet is adjusted such that dashed lines allocated to each sheet coincide when viewed in the direction of the Z axis.

Figure 22B:
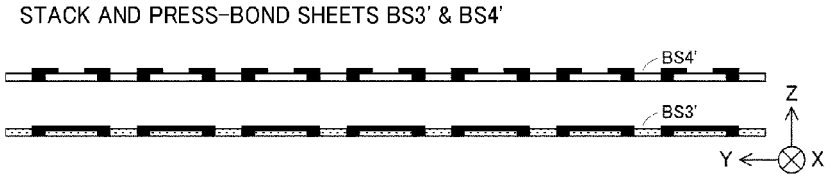
FIG. 22B is a process chart showing another portion of the process for manufacturing a stack-type inductor element in another preferred embodiment of the present invention, and FIG. 22C a process chart showing still another portion of the process for manufacturing a stack-type inductor element in another preferred embodiment of the present invention.

Similarly, mother sheets BS3' and BS4' are stacked and press-bonded in such a position that the upper surface of mother sheet BS3' faces a lower surface of mother sheet BS4' (see FIG. 22B). Here again, a position of stack of each sheet is adjusted such that dashed lines allocated to each sheet coincide when viewed in the direction of the Z axis.

Figure 22C:
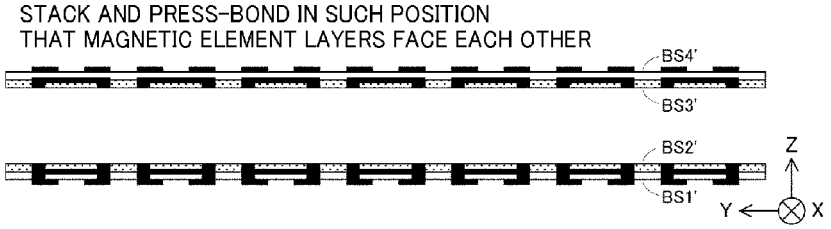
Figure 23A:
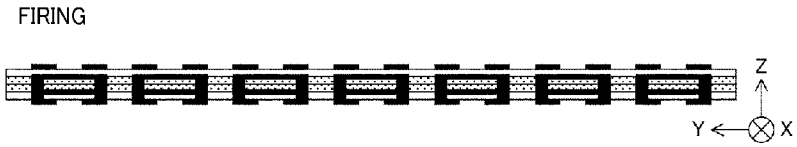
FIG. 23A is a process chart showing yet another portion of the process for manufacturing a stack-type inductor element in another preferred embodiment of the present invention.
Figure 23B:
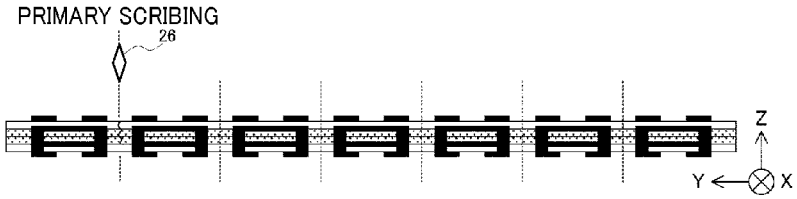
FIG. 23B is a process chart showing another portion of the process for manufacturing a stack-type inductor element in another preferred embodiment of the present invention.
Figure 23C:
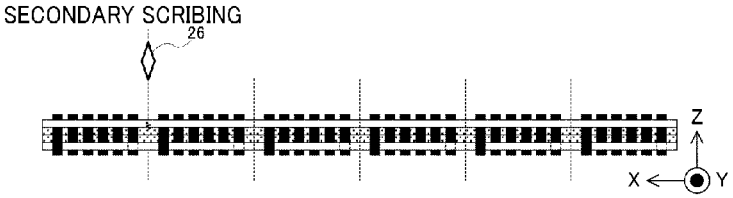
FIG. 23C is a process chart showing still another portion of the process for manufacturing a stack-type inductor element in another preferred embodiment of the present invention.

In succession, a vertical direction of the stack based on mother sheets BS1' and BS2' is inverted, and the stack based on mother sheets BS3' and BS4' is additionally stacked and press-bonded (see FIG. 22C). Here, a position of stack is adjusted such that the lower surface of mother sheet BS3' faces the upper surface of mother sheet BS2' and dashed lines allocated to each sheet coincide when viewed in the direction of the Z axis. Thus, an unprocessed substrate assembly of which thickness preferably is reduced to about 0.4 mm or smaller, for example, is fabricated. The fabricated substrate assembly is fired (see FIG. 23A), and thereafter subjected to primary scribing and secondary scribing (see FIGS. 23B and 23C).

In primary scribing, a blade of scriber 26 is applied along the dashed line extending in the direction of the X axis, and in secondary scribing, the blade of scriber 26 is applied along the dashed line extending in the direction of the Y axis. In any of primary scribing and secondary scribing, a groove is formed in an upper surface of the substrate assembly. It is noted that a groove formed in primary scribing reaches non-magnetic element layer 12*b*, whereas a groove formed in secondary scribing reaches only magnetic element layer 12*a*. As scribing is completed, the substrate assembly is broken into division units, to thus obtain a plurality of stack-type inductor elements 10, 10.

In this preferred embodiment as well, in the fired substrate assembly, residual stress originating from a difference in coefficient of thermal expansion between a material of pad electrodes 14*a* and 14*b* and linear conductors 16 and 18 and a material of magnetic element layer 12*a* or non-magnetic element layers 12*b* and 12*c* is caused. It is noted that pad electrodes 14*a* and 14*b* provided on the opposing main surfaces of stack 12 preferably are mirror symmetric to each other and therefore warpage of the substrate assembly originating from residual stress is significantly reduced or prevented and stack-type inductor element 10 obtained by breakage is smaller in thickness.

It is noted that linear conductor 16 preferably extends obliquely to the Y axis, whereas linear conductor 18 preferably extends in the direction of the Y axis in the preferred embodiment described above. So long as linear conductors 16 and 18 are connected like a coil by via hole conductors 20*a* and 20*b*, however, a direction of extension of linear conductors 16 and 18 may be different from that in this preferred embodiment.

In addition, in the preferred embodiment described above, a conductor pattern corresponding to linear conductors 18 preferably is printed on the upper surface of mother sheet BS3 or BS3'. The conductor pattern corresponding to linear conductor 18, however, may be printed on the lower surface of mother sheet BS4 or BS4'.

Moreover, in this preferred embodiment, ceramic sheets SH2 and SH3 preferably are stacked to define magnetic element layer 12*a*. Magnetic element layer 12*a* may be provided, however, by stacking a plurality of ceramic sheets corresponding to magnetic element layer ceramic sheet SH2 and ceramic sheet SH3.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A stack-type inductor element, comprising:

a stack including a magnetic element layer and having a rectangular or substantially rectangular shape when viewed in a stacking direction of the stack;

a coil-shaped conductor pattern provided in the stack;

a plurality of first pad electrodes provided on a first main surface of the stack; and a plurality of second pad electrodes provided on a second main surface of the stack and symmetric to the plurality of first pad electrodes; wherein a first end and a second end of the coil-shaped conductor pattern is electrically connected to two of the plurality of first pad electrodes, respectively, and the plurality of second pad electrodes are all electrically open; and the first and second main surfaces of the stack respectively define uppermost and lowermost surfaces of the ceramic laminate.

2. The stack-type inductor element according to claim 1, wherein the stack has a rectangular or substantially rectangular shape when viewed in the stacking direction of the stack and the plurality of first pad electrodes are arranged in two rows along a longitudinal direction of the stack.

3. The stack-type inductor element according to claim 1, wherein a number of the first pad electrodes is three or more and a pad electrode not connected to the coil-shaped conductor pattern of the plurality of first pad electrodes is electrically open.

4. The stack-type inductor element according to claim 1, wherein the stack includes non-magnetic element layers superimposed on opposing main surfaces of the magnetic element layer.

5. The stack-type inductor element according to claim 1, wherein the coil-shaped conductor pattern includes an axis of winding in a direction parallel or substantially parallel to the main surface of the magnetic element layer.

6. The stack-type inductor element according to claim 5, wherein the stack has a rectangular or substantially rectangular shape when viewed in the stacking direction of the stack and the axis of winding is parallel or substantially parallel to a longitudinal direction of the rectangular shape.

7. The stack-type inductor element according to claim 1, wherein the coil-shaped conductor pattern is a coil antenna.

* * * * *